United States Patent [19]

Middlemiss et al.

[11] 4,213,231

[45] Jul. 22, 1980

[54] MANUFACTURE OF METAL STRIP

[75] Inventors: Andrew Middlemiss; Dalip T. Malkani, both of Sheffield, England

[73] Assignee: British Steel Corporation, London, England

[21] Appl. No.: 924,723

[22] Filed: Jul. 14, 1978

[30] Foreign Application Priority Data

Jul. 13, 1977 [GB] United Kingdom ..... 29804/77

[51] Int. Cl.[2] ..... B21C 37/04; B21C 37/02

[52] U.S. Cl. ..... 29/18

[58] Field of Search ..... 29/18, 17 R; 82/46 R, 82/47, 100, 101; 72/71, 324; 242/75.45, 75.47, 75.5, 67.5

[56] References Cited

U.S. PATENT DOCUMENTS

| | | | |
|---|---|---|---|
| 3,262,182 | 7/1966 | Duret et al. | 29/18 |
| 3,355,971 | 12/1967 | Vigor | 82/47 |
| 3,397,438 | 8/1968 | Montoro | 29/18 |
| 3,460,366 | 8/1969 | Musial et al. | 29/17 R X |
| 3,603,186 | 9/1971 | Vigor | 82/46 |
| 4,070,739 | 1/1978 | Hague et al. | 29/18 |
| 4,075,747 | 2/1978 | Hague et al. | 29/18 |
| 4,085,496 | 4/1978 | Malkani et al. | 29/18 |

FOREIGN PATENT DOCUMENTS

| | | |
|---|---|---|
| 812920 | 5/1959 | United Kingdom . |
| 1121700 | 8/1966 | United Kingdom . |

*Primary Examiner*—Horace M. Culver
*Attorney, Agent, or Firm*—Jesse B. Grove, Jr.

[57] ABSTRACT

Metal strip is peeled from the periphery of a rotating cylindrical workpiece by feeding a cutting tool continuously into the workpiece periphery and is collected by winding the peeled strip around a rotating coiler. The rotational speed of either the workpiece or the coiler is controlled to maintain its peripheral speed substantially constant at the angular velocity of, respectively, the coiler or the workpiece is controlled in accordance with a time-dependent derived relationship to maintain a set ratio between the peripheral speeds of the workpiece and the coiler.

8 Claims, 5 Drawing Figures

MANUFACTURE OF METAL STRIP

Figure 1:
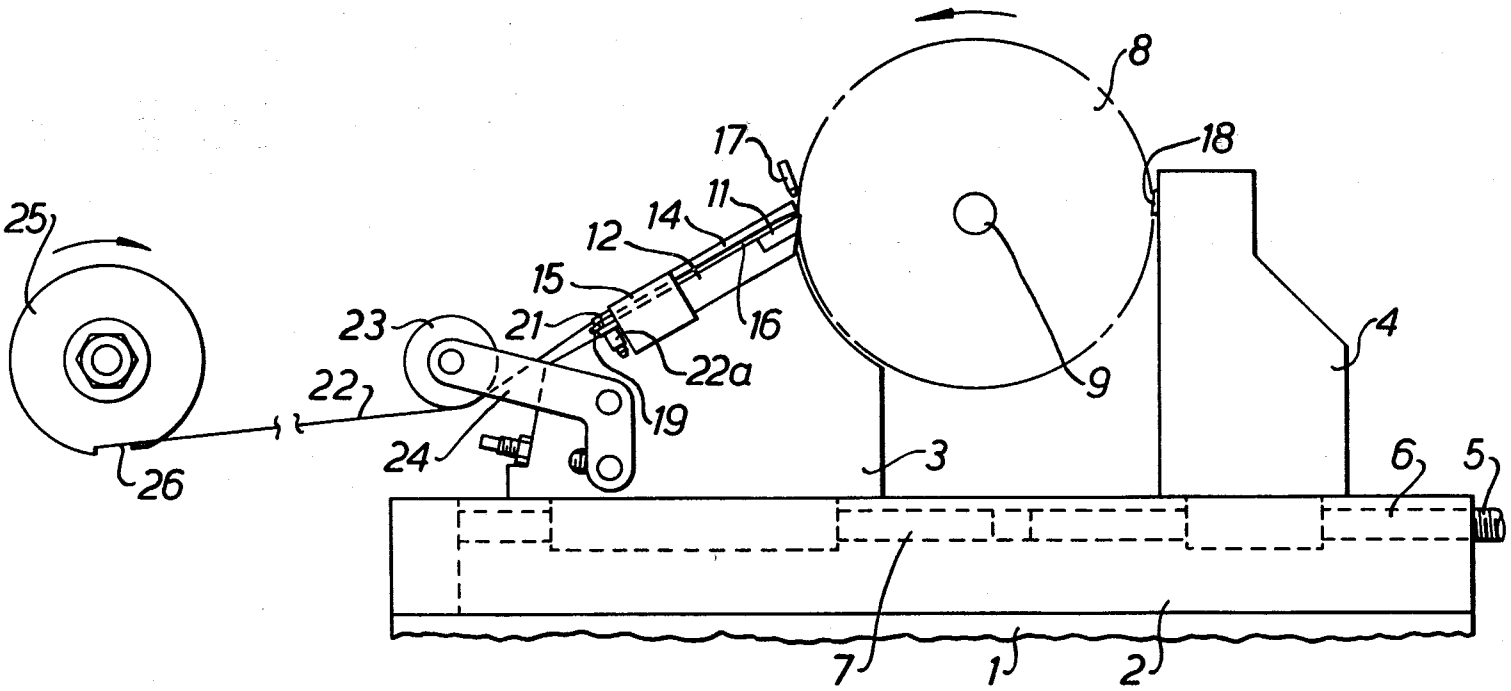

This invention relates to the manufacture of metal strip. In particular it is concerned with the manufacture of metal strip by peeling a layer of metal from the surface of a rotating cylindrical workpiece by means of a cutting tool fed continuously into the periphery of the workpiece and collecting the peeled strip around a rotating coiler.

The thickness of the metal strip manufactured in this way is dependent upon the ratio of the thickness of the chip formed in the surface of the workpiece ahead of the cutting tool and the depth of cut produced by the cutting tool. This ratio is commonly termed the 'gather ratio' and is, in turn, dependent upon the material being peeled, the peeling speed, and the tension applied to the strip as it is peeled from the surface of the workpiece.

Previous proposals for controlling the gauge of peeled strip have centered around detecting errors in the required gather ratio from measurements of the peeled strip speed or thickness and controlling the rotational speed of the wind-up mandrel in dependence upon such detected errors. These proposals suffer from a number of disadvantages, consequent on the impracticability of making precise measurements of the speed or thickness of the strip leaving the rotating workpiece. Accurate measurements of the thickness of the peeled strip by means of a suitable gauge positioned between the workpiece and the mandrel is impracticable because the strip surface not contacted by the cutting tool exhibits a roughened matt-like texture dissimilar to the polished surface of the strip which has been contacted by the cutting tool.

Accurate measurement of strip speed requires constant and evenly applied physical contact between a suitable gauge, eg. a tachometer and at least one surface of the strip. Such contact cannot be achieved with peeled strip which inevitably is covered with lubricant and coolant.

The present invention sets out to provide a procedure for providing consistent thickness control of peeled strip which avoids the need for direct measurement of the thickness or speed of the peeled strip.

In accordance with one aspect of the present invention there is provided a method of manufacturing metal strip from a cylindrical workpiece which includes the steps of rotating the workpiece about its axis, feeding a cutting tool at a predetermined rate continuously into the peripheral surface of the rotating workpiece to produce a continuous metal strip peeled from the periphery of the workpiece, collecting the peeled strip by winding it around a rotating coiler, controlling the rotational speed of either (a) the workpiece or (b) the coiler, to maintain its peripheral speed substantially constant, and controlling the angular velocity of either (b) the coiler or (a) the workpiece respectively in accordance with a time-dependent derived relationship to maintain a predetermined ratio between the peripheral speeds of (a) the workpiece and (b) the coiler.

In accordance with the present invention in another aspect there is provided a method of manufacturing metal strip from a cylindrical workpiece which includes the steps of rotating the workpiece about its axis, feeding a cutting tool at a predetermined rate continuously into the peripheral surface of the rotating workpiece to produce a continuous metal strip peeled from the periphery of the workpiece, collecting the peeled strip by winding it around a rotating coiler, controlling the rotational speed of the workpiece to maintain its peripheral speed substantially constant and controlling the rotational speed of the coiler in accordance with the following time-dependent derived relationship:

$$W_c = \frac{v_b}{\sqrt[g]{r_{co}^2 + \frac{4v_b}{\pi} f \cdot t}}$$

where:

$W_c$ is the required angular velocity of the coiler at time t $r_{co}$ is the coiler mandrel diameter $v_b$ is the billet surface speed f is the present tool feed rate per billet revolution g is the predetermined chip thickness (gather) ratio to maintain a predetermined ratio between the peripheral speeds of the workpiece and the coiler.

In accordance with the present invention in a further aspect there is provided a method of manufacturing metal strip from a cylindrical workpiece which includes the steps of rotating the workpiece about its axis, feeding a cutting tool at a predetermined rate continuously into the peripheral surface of the rotating workpiece to produce a continuous metal strip peeled from the periphery of the workpiece, collecting the peeled strip by winding it around a rotating coiler, controlling the angular velocity of the workpiece to maintain its peripheral speed substantially constant and controlling the rotational speed of the coiler in accordance with the following time-dependent derived relationship:

$$W_c = \frac{v_b\, 2\pi}{g(nh + 2\pi r_{co})}$$

where:

h is the required strip thickness n is the total angular rotation (radians) of the coiler and $W_c$, $v_b$, g, and $r_{co}$ are as defined above, to maintain a predetermined ratio between the peripheral speeds of the workpiece and the coiler.

In accordance with the present invention in a further aspect there is provided a method of manufacturing metal strip from a cylindrical workpiece which includes the steps of rotating the workpiece about its axis, feeding a cutting tool at a predetermined rate continuously into the peripheral surface of the rotating workpiece to produce a continuous metal strip peeled from the periphery of the workpiece, collecting the peeled strip by winding it around a rotating coiler, controlling the angular velocity of the workpiece to maintain its peripheral speed substantially constant and controlling the angular velocity of the coiler in accordance with the following time-dependent derived relationship:

$$W_c = \frac{W_b\, r_b}{\sqrt[g]{r_{bo}^2 - r_b^2 + r_{co}^2}}$$

where:

$r_b$ is the current billet radius (measured)

$r_{bo}$ is the initial billet radius $W_b$ is the angular velocity of the billet, and g and $r_{co}$ are as defined above, to maintain a predetermined ratio between the peripheral speeds of the coiler and the workpiece.

According to the present invention in a still further aspect there is provided a method of manufacturing metal strip from a cylindrical workpiece which includes the steps of rotating the workpiece about its axis, feeding a cutting tool at a predetermined rate continuously into the peripheral surface of the rotating workpiece to produce a continuous metal strip peeled from the periphery of the workpiece, collecting the peeled strip by winding it around a rotating coiler, controlling the angular velocity of the coiler to maintain its peripheral speed substantially constant and controlling the angular velocity of the workpiece in accordance with the following time-dependent derived relationship:

$$W_b = g\frac{W_{co}}{r_b}\sqrt{r_{bo}^2 + r_{co}^2 - r_b^2}$$

where:

$W_{co}$ is the initial angular velocity of the coiler and g, $r_b$, $r_{bo}$, and $r_{co}$ are as defined above, to maintain a predetermined ratio between the peripheral speeds of the workpiece and the coiler.

The peeled strip leaving the workpiece is preferably held at a substantially constant angle to the tangent of the workpiece at the position where the cutting tool engages the workpiece. The leading portion of the peeled strip may initially be directed towards the coiler by means of a fluid jet, eg. a jet of compressed air.

The peripheral speed of workpiece and the rate at which the cutting tool is fed into the workpiece periphery are conveniently controlled to maintain the rate at which strip is peeled from the workpiece substantially constant.

The workpiece may be disc-shaped, ie. its longitudinal axis is equal in length to the width of the peeled strip. Alternatively, the workpiece may be in a billet form, the length of the billet's longitudinal axis being greater than the width of the peeled strip. In this case strip may be peeled in turn from sections of the billet by using a parting tool in combination with the cutting tool. A function of the parting tool is to cut a groove in the peripheral surface of the billet ahead of the cutting tool so that the peeled strip has two free edges as it is cut or peeled from the billet. This arrangement is described in greater detail in U.S. Pat. No. 4,075,747. In both cases the workpiece may be of annular configuration.

Peeled strip leaving the drive means may initially be fed onto and around the periphery of the coiler by gripping the leading portion of the strip between the coiler periphery and a flexible belt connected at one end to the coiler and wound with the strip leading portion around the coiler thereby to guide the peeled strip around the coiler. Two belts may be provided, the strip leading portion being sandwiched between the belts as it travels around the periphery of the coiler. This arrangement is described in greater detail in our co-pending patent application Ser. No. 27050/76 now U.K. Pat. No. 1,546,948.

Alternatively, the leading portion of the peeled strip leaving the drive means may be guided onto and around the coiler periphery by means of the arrangement described in U.S. Pat. No. 4,075,747.

In this arrangement, the leading portion of the strip is gripped by a clamp connected by a flexible linkage to the coiler. The flexible linkage may include a metal strip which in use is wrapped around the coiler periphery and the clamp preferably has jaws which are resiliently biased towards one another and are initially so mounted that actuation of the coiler causes the clamp jaws to close on and grip the leading portion of the strip.

The invention will now be described by way of example with reference to the accompanying diagrammatic drawings in which FIG. 1 is an elevation of apparatus for manufacturing metal strip in accordance with the invention, and FIGS. 2 to 5 are block diagrams of four alternative systems for controlling the thickness of the strip manufactured in accordance with the invention.

Referring to FIG. 1, a bedway 1 supports a horizontal slideway 2 along which the peeling tool holder 3 and a parting tool holder 4 can be driven towards one another by a common lead screw 5 connected to a hydraulic drive motor (not shown). The lead screw 5 has a first section 6 associated with the parting tool holder 4 which is threaded in an opposite sense to a second section 7 associated with the peeling tool holder 3. An annular steel billet 8 is mounted for rotation on a spindle 9 between the tool holders 3,4. The spindle 9 is driven by the same hydraulic motor as that which drives the lead screw 5 although the gearing is different.

A peeling tool 11 mounted on a tool block 12 is rigidly secured to the peeling tool holder 3 such that the cutting edge of the tool 11 engages the periphery of the billet 8. A strip guide plate 14 is held by a support 15 mounted on the tool holder 3 so that it is spaced a small distance away from and parallel to the upper surface of the tool block to define a gallery 16 along which strip can pass after being peeled from the periphery of the billet by the tool 11. Positioned between the guide plate 14 and the billet periphery is a gas injection nozzle 17 connected to a source of compressed air (not shown).

A parting tool 18 is mounted on the holder 4 and cuts a small groove in the billet as it rotates at a location spaced from the billet edge equal to the required width of strip to be peeled from the billet.

Two locating pins 19 extend from the guide plate support 15 on the side of the support 15 distant from the tool block 12. The pins 19 are spaced apart from one another by a distance slightly greater than the width of the peeling tool 11. Prior to the commencement of strip peeling a clamp 21 is fitted on the locating pins 19 such that the jaws of the clamp 21 which are resiliently biased towards one another by two sets of disc springs 22*a* are held apart by the pins 19. A guide strip 22 made of shim steel is attached to the clamp 21 and extends away from the guide plate support 15 around the lower portion of an idler roller 23 mounted on an adjustable arm 24 which is fitted on the peeling tool holder 3. The guide strip 22 at its end distant from the clamp 21 is attached to the periphery of a coiling drum 25 with a recess 26 formed in the drum periphery. The drum 25 is drivable in the direction shown by the arrow in FIG. 1 by drive means (not shown) which is independent of the hydraulic drive for the rotatable billet 8. A mechanical or magnetic clutch system (not shown) is interposed between the drive means and the drum 25 to facilitate rapid acceleration of the drum to its required operating speed.

Upon starting up the equipment, the drive means to the coiling drum 25 is actuated with the clutch system disengaged. At the same time, drive to the billet is initiated, the peripheral speed of the billet gradually increasing whilst the parting tool 18 and the peeling tool 11 are simultaneously driven into the peripheral surface of the billet 8. Since the parting tool cuts a narrow groove about 180° before the peeling tool engages that portion of the billet, the peeling tool is able to cut cleanly the required width of steel strip from the billet 8. The leading portion of the peeled strip is directed into the gallery 16 by a blast of compressed air issuing from the nozzle 17. The air blast prevents the leading edge of the strip from fouling the edges or faces of the guide plate 14. Alternatively, or additionally, air under pressure may be injected into the gallery through a multiplicity of nozzles set in the guide plate 14. The clutch system of the coiling drum drive is then engaged, either manually or in response to a sensor (not shown) which determines the pressure of the strip at the clamp 21, and the peripheral speed of the coiler set at a value which is controlled in the manner described below at a constant proportion (between 0.85 and 0.28) of the peripheral speed of the rotatable billet. The guide strip 22 is thereby pulled around the coiling drum 25. The guide strip 22 in turn pulls the clamp 21 off the locating pins 19, the disc springs 22*a* causing the jaws of the clamp 21 to grip the leading section of peeled strip. The peeled strip is thus pulled around the coiling drum 25 at a constant level of tension determined by the ratio between the peripheral speed of the rotatable billet and the strip speed which ensures that constant thickness is maintained even during periods of acceleration. The upper surface of the clamp 21 is shaped so that the next lap of peeled strip forms a circular lap around the coiling drum 25. An idler roller 23 ensures that the peeled strip is pulled away from the billet 8 at a constant angle, irrespective of the changing diameter of the coil of peeled strip accumulating on the coiling drum 25.

The apparatus is now run until the section of billet 8 which is being peeled is reduced to a small diameter, the peeled strip being gathered on the coiling drum 25. The apparatus is then stopped and the full coiler drum 25 removed and replaced with an empty drum complete with guide strip 22 and clamp 21. At the same time the peeling tool holder 3 and the parting tool holder 4 are returned to their original position and the billet 8 is advanced so that the next section of billet 8 is presented to the peeling tool 11. The operation of the apparatus is then repeated in the manner described previously. The peeled strip which has accumulated on the coiler drum 25 is decoiled onto a separate mandrel (not shown) so that the coiler drum and clamp can be re-used in the apparatus.

In order to cool the steel strip peeled from the billet 8, a number of cooling fluid inlets (not shown) are provided which pass through the guide plate 14 and direct fluid onto the peeled strip. Alternatively, compressed air or other suitable fluid may be passed through inlets in the guide plate 14 and/or the tool block 12 into the gallery 16 through which the strip 8 passes. The air or other fluid provides a fluid bearing which reduces the possibility of the leading portion of the strip jamming within the gallery. Alternatively, or additionally the surfaces of the gallery can be coated with an anti-friction material.

Various control procedures for maintaining a predetermined ratio between the peripheral speeds of the billet 8 and the coiler drum 25 which do not rely upon direct measurement of the thickness or speed of the peeled strip will now be described.

For the reasons given previously, direct measurement of peeled strip speed and/or strip thickness, is impracticable. Strip speed and peeling speed are not, however, independent parameters and it is therefore possible to control the rotational speed of the coiler or the billet in accordance with a predetermined time-dependent derived relationship which takes into account such parameters as billet (or coiler) rotational speed and the rate at which the cutting tool is fed into the billet without the need either to directly or indirectly measure the speed or thickness of the peeled strip.

A convenient control requirement for the process is a constant peeling speed. When operating with a constant peeling speed the thickness of the strip peeled from the billet 8 depends upon the linear rate at which the peeled strip is wound onto the coiler; thus, to achieve constant strip thickness, the linear rate of take-up of strip onto the coiler must be maintained at a constant value.

Figure 2:
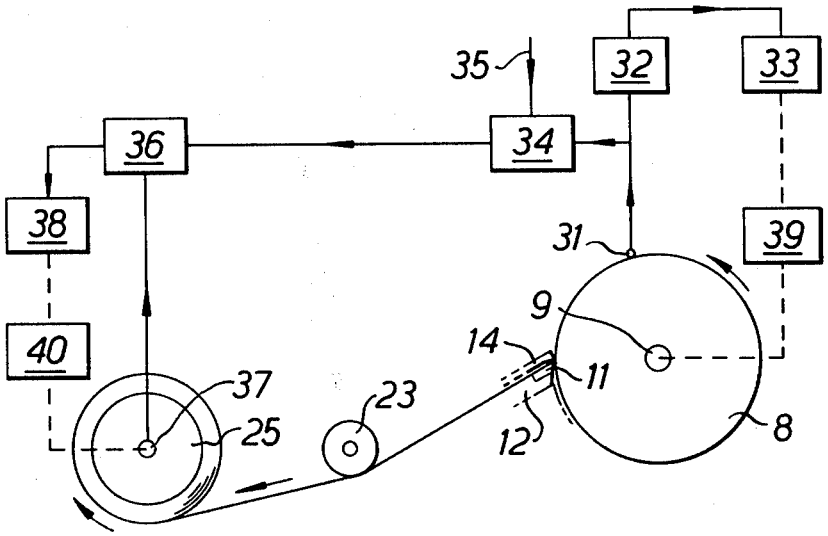

In the control procedure illustrated in FIG. 2, peeling speed is maintained constant and the coiler rotational speed is controlled in accordance with a derived time variable control relationship to maintain the linear rate of take-up of strip onto the coiler constant. The peripheral speed of the billet is measured by means of a tachometer 31 in contact with the billet surface. An electrical signal representative of the billet surface speed is passed to a comparator 32 in which it is compared with a set reference value and the error signal from the comparator 32 is relayed to a speed controller 33 of the motor driving the billet 8 to maintain the billet surface speed constant. In an alternative arrangement, the current diameter of the billet is measured by, for example, a device which detects the position of the peeling tool post, and the drive motor 39 of the billet controlled to maintain the billet peripheral speed constant.

The electrical output signals from the tachometer 31 also pass to a computor 34. The computer also receives input signals through channel 35 representative of the time elapsed from the start of the peeling operation. From these two inputs and from a knowledge of coiler mandrel diameter, peeling tool feed rate and required chip thickness (all of which remain constant throughout the peeling operation), the computer calculates the current angular velocity of the coiler 25 in accordance with the control relationship:

$$W_c = \frac{v_b}{\sqrt[g]{r_{co}^2 + \frac{4v_b f}{\pi} \cdot t}}$$

where:

$W_c$ is the required angular velocity of the coiler at time t $r_{co}$ is the coiler mandrel diameter $v_b$ is the billet surface speed f is the tool feed rate per billet revolution g is the required chip thickness (gather) ratio Output signals from the computer 34 representative of the calculated required coiler angular velocity are transmitted to a comparator 36 in which they are compared with signals representative of the current angular velocity of the coiler 25 as measured by a tachometer 37. Errors between these calculated and measured values are then passed to a controller 38 operable to control, through drive motor 40, the angular velocity of the coiler to bring it into line with the value calculated by the computer 34. It will be understood that the only variable present in the righthand side of the equation is t. Thus, the angular velocity of the coiler drum is varied periodically or continuously throughout the peeling operation in accordance with the above control relationship in order to achieve consistent control of the thickness of the peeled strip.

Figure 3:
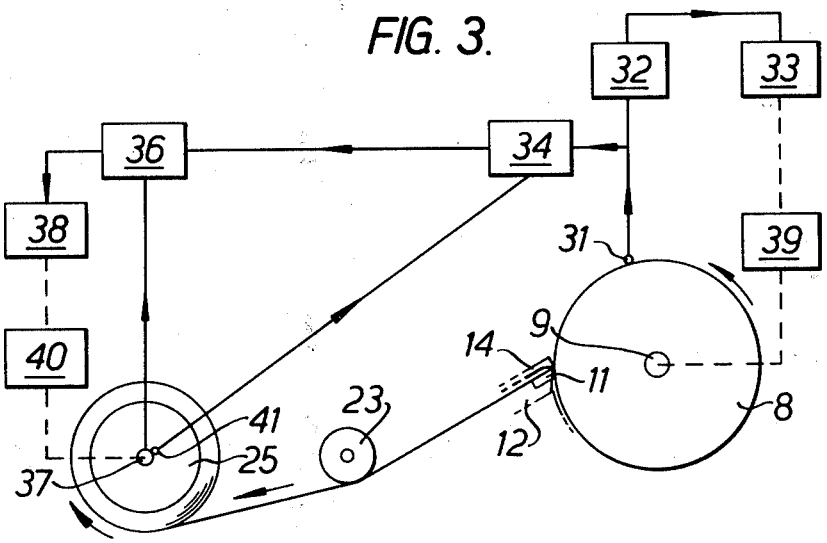

In the control system illustrated in FIG. 3 (in which like integers bear the same reference numerals) the peripheral speed of the billet is again maintained constant in the manner described above. In this embodiment however, the computer receives in addition to input signals representative of billet peripheral speed, signals from a device 41 representative of the total angular rotation of the coiler from initiation of the peeling process. From these input signals the computer 34 calculates the required coiler angular velocity in accordance with the following relationship:

$$W_c = \frac{v_b\, 2\pi}{g(nh + 2\pi r_{co})}$$

where:

h is the required strip thickness n is the total angular rotation (radians) of the coiler and $W_c$, $v_b$, g, and $r_{co}$ are as defined above.

The coiler angular velocity is thereafter controlled in the same way as is described with reference to FIG. 2 to maintain a given relationship between the peripheral speeds of the billet and the coiler.

Figure 4:
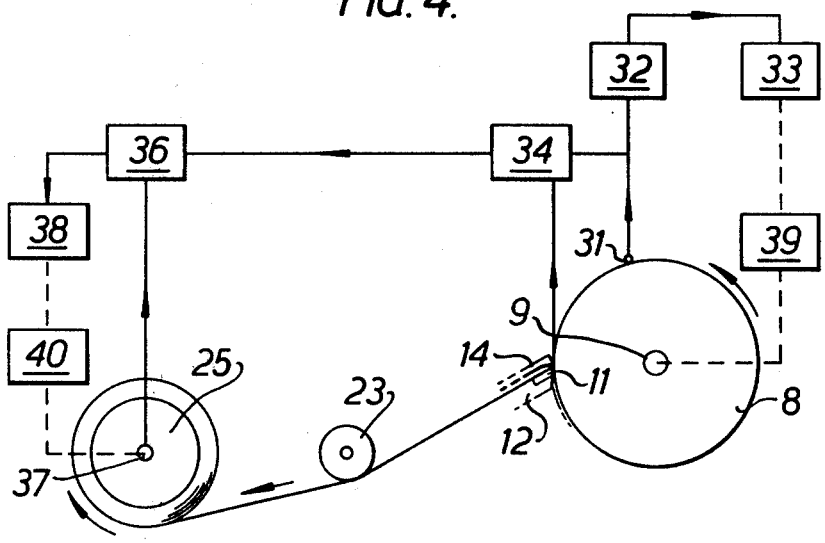
Figure 5:
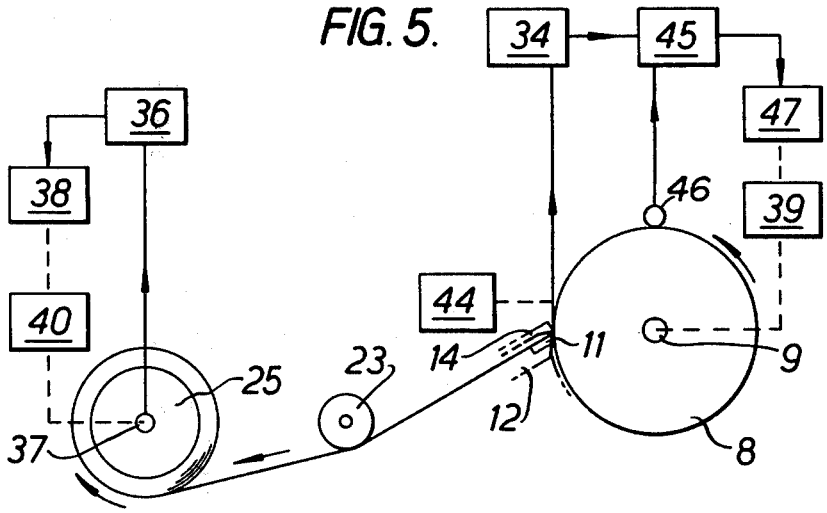

The control system illustrated in FIG. 4 is similar to those illustrated in FIGS. 2 and 3. In this embodiment, the computer 34 receives input signals representative of surface speed ($v_b$) of the billet and of the current billet radius ($r_b$) and calculates from these values and from a knowledge of the initial billet radius and the coiler mandrel diameter, the required angular velocity of the coiler in accordance with the relationship:

$$W_c = \frac{v_b}{\sqrt[g]{r_{bo}^2 - r_b^2 + r_{co}^2}}$$

where:

$r_b$ is the current billet radius (measured)

$r_{bo}$ is the initial billet radius and $W_c$, $v_b$, g, and $r_{co}$ are as defined above.

As in the previous embodiments, the angular velocity of the coilar is controlled to remove errors between this calculated value and a measured value. In the three previously discussed control procedures, billet surface speed is maintained constant and the coiler rotational speed is continuously or periodically varied to compensate for changes in coiler diameter. In the system illustrated in FIG. 5, this is not the case. Here the billet surface speed is varied in accordance with the speed changes demanded by the coiler mandrel rotating at constant angular velocity. This is achieved by controlling the billet angular velocity, $W_b$, in dependence upon changes in billet current radius in accordance with the following formula:

$$W_b = g\frac{W_{co}}{r_b}\sqrt{r_{bo}^2 + r_{co}^2 - r_b^2}$$

The several symbols in the foregoing formula are explained and defined below.

The angular velocity ($W_c$) of the coiler is measured by a tachometer 37, is compared with a set value recorded in a comparator 36 and any errors between these two values are passed to a speed controller 38 to eliminate the recorded error. The computer 34 receives signals representative of the current billet radius ($r_b$) as measured by a device 44 which detects the position of the peeling tool post and calculates from a knowledge of the present tool feed rate (g) the initial coiler angular velocity ($W_{co}$) and the coiler mandrel diameter ($r_{co}$), the required value of billet angular velocity ($W_b$). A signal representative of this calculated value is passed as an input to a comparator 45 in which it is compared with a signal from a tachometer 46 representative of the actual value of billet angular velocity. Error signals from the comparator 45 are passed to a speed controller 47 to control the angular velocity of the billet.

We claim:

1. A method of manufacturing metal strip from a cylindrical workpiece which comprises the steps of rotating the workpiece about its axis, feeding a cutting tool at a predetermined rate continuously into the peripheral surface of the rotating workpiece to produce a continuous metal strip peeled from the periphery of the workpiece, collecting the peeled strip by winding it around a rotating coiler, controlling the rotational speed of (a) the workpiece and (b) the coiler, to maintain their peripheral speed substantially constant, and controlling the angular velocity of (b) the coiler and (a) the workpiece, respectively, in accordance with a time-dependent derived relationship to maintain a predetermined ratio between the peripheral speeds of (a) the workpiece and (b) the coiler, the peripheral speed of the workpiece being kept constant when the angular velocity of the coiler is being controlled in accordance with said time-dependent derived relationship, the peripheral speed of the coiler being kept constant when the angular velocity of the workpiece is being controlled in accordance with said time-dependent derived relationship.

2. A method as claimed in claim 1 wherein the rotational speed of the workpiece is controlled to maintain its peripheral speed substantially constant and the rotational speed of the coiler is controlled in accordance with the following time-dependent derived relationship:

$$W_c = \frac{v_b}{\sqrt[g]{r_{co}^2 + \frac{4v_b}{\pi} f \cdot t}}$$

Where:

$W_c$ is the required angular velocity of the coiler at time t $r_{co}$ is the coiler mandrel diameter $v_b$ is the billet surface speed f is the present tool feed rate per billet revolution g is the predetermined chip thickness (gather) ratio to maintain a predetermined ratio between the peripheral speeds of the workpiece and the coiler.

3. A method as claimed in claim 1 wherein the angular velocity of the workpiece is controlled to maintain its peripheral speed substantially constant and the rotational speed of the coiler is controlled in accordance with the following time-dependent derived relationship:

$$W_c = \frac{v_b 2\pi}{g(nh + 2\pi r_{co})}$$

where:

h is the required strip thickness, n is the total angular rotation (radians) of the coiler, $W_c$ is the angular velocity of the coiler, $v_b$ is the billet surface speed g is the predetermined chip thickness (gather) ratio and $r_{co}$ is the coiler mandrel diameter to maintain a predetermined ratio between the peripheral speeds of the workpiece and the coiler.

4. A method as claimed in claim 1 wherein the angular velocity of the workpiece is controlled to maintain its peripheral speed substantially constant and the angular velocity of the coiler is controlled in accordance with the following time-dependent derived relationship:

$$W_c = \frac{W_b r_b}{\sqrt[g]{r_{bo}^2 - r_b^2 + r_{co}^2}}$$

where:

$r_b$ is the current billet radius (measured), $r_{bo}$ is the initial billet radius, $W_c$ is the angular velocity of the coiler, $W_b$ is the angular velocity of the workpiece, g is the predetermined chip thickness (gather) ratio, and $r_{co}$ is the coiler mandrel diameter, to maintain a predetermined ratio between the peripheral speeds of the coiler and the workpiece.

5. A method as claimed in claim 1 wherein the angular velocity of the coiler is controlled to maintain its peripheral speed substantially constant and controlling the angular velocity of the workpiece is controlled in accordance with the following time-dependent derived relationship:

$$W_b = g\frac{W_{co}}{r_b}\sqrt{r_{bo}^2 + r_{co}^2 - r_b^2}$$

where:

$W_{co}$ is the initial angular velocity of the coiler, $W_b$ is the angular velocity of the workpiece, g is the predetermined chip thickness (gather) ratio, $r_b$ is the current measured workpiece thickness $r_{bo}$ is the initial workpiece thickness, and $r_{co}$ is the coiler mandrel diameter, to maintain a predetermined ratio between the peripheral speeds of the workpiece and the coiler.

6. A method as claimed in any one of the preceding claims wherein the peeled strip leaving the workpiece is held at a substantially constant angle to the tangent of the workpiece at the position where the cutting tool engages the workpiece.

7. A method as claimed in any one of claims 1–5 wherein the peripheral speed of the workpiece and the rate at which the cutting tool is fed into the workpiece periphery are controlled to maintain the rate at which strip is peeled from the workpiece substantially constant.

8. A method as claimed in claim 6 wherein the peripheral speed of the workpiece and the rate at which the cutting tool is fed into the workpiece periphery are controlled at maintain the rate at which strip is peeled from the workpiece substantially constant.

* * * * *